United States Patent [19]

Avery, Jr.

[11] Patent Number: 4,528,826

[45] Date of Patent: Jul. 16, 1985

[54] REFRIGERANT ACCUMULATOR AND CHARGING APPARATUS AND METHOD FOR VAPOR-COMPRESSION REFRIGERATION SYSTEM

[76] Inventor: Richard J. Avery, Jr., 5419 Mercedes, Dallas, Tex. 75206

[21] Appl. No.: 625,464

[22] Filed: Jun. 28, 1984

Related U.S. Application Data

[62] Division of Ser. No. 421,882, Sep. 23, 1982, Pat. No. 4,474,034.

[51] Int. Cl.[3] ..... F25B 43/00

[52] U.S. Cl. ..... 62/503; 62/292

[58] Field of Search ..... 62/292, 503

[56] References Cited

U.S. PATENT DOCUMENTS

| | | | |
|---|---|---|---|
| 2,760,355 | 8/1956 | Swart | 62/170 |
| 2,770,105 | 11/1956 | Colton | 62/503 |
| 3,012,414 | 12/1961 | La Porte | 62/503 |
| 3,071,935 | 1/1963 | Kapeker | 62/503 |
| 3,302,421 | 2/1967 | Karnes | 62/292 |
| 3,370,440 | 2/1968 | Kellie | 62/503 |
| 3,412,574 | 11/1968 | Reiter | 62/471 |
| 3,487,656 | 1/1970 | Grant | 62/503 |
| 3,525,231 | 8/1970 | Armstrong | 62/125 |
| 3,600,904 | 5/1969 | Tuney | 62/196 |
| 3,779,035 | 12/1973 | Kramer | 62/503 |
| 3,792,594 | 2/1974 | Kramer | 62/503 |
| 3,824,802 | 7/1974 | Scherer et al. | 62/217 |
| 3,837,177 | 9/1974 | Rockwell et al. | 62/503 |
| 3,875,755 | 4/1975 | Anderson et al. | 62/77 |
| 3,903,709 | 9/1975 | Anderson et al. | 62/77 |
| 3,919,859 | 11/1975 | Ross | 62/503 |
| 4,068,493 | 1/1978 | Micai et al. | 62/503 |
| 4,094,168 | 6/1978 | Hamner et al. | 62/347 |
| 4,319,459 | 11/1980 | Hamnett et al. | 62/77 |

FOREIGN PATENT DOCUMENTS

| | | |
|---|---|---|
| 3032084 | 8/1980 | Fed. Rep. of Germany . |
| 1348272 | 2/1963 | France . |
| 2369510 | 5/1978 | France . |

*Primary Examiner*—Ronald C. Capossela

*Attorney, Agent, or Firm*—Hubbard, Thurman Turner & Tucker

[57] ABSTRACT

A refrigerant fluid accumulator and charging apparatus for vapor-compression refrigeration systems comprising a pressure vessel having an interior liquid/vapor separation chamber, a liquid reservoir, a refrigerant inlet conduit, a primary refrigerant vapor outlet conduit and a secondary refrigerant outlet conduit in communication with a sump portion of the reservoir and with the primary outlet conduit. The secondary refrigerant outlet conduit includes a sight glass for observation of the flow of fluid from the sump into the compressor suction line. Refrigeration systems may be accurately charged with refrigerant fluid by operating the system at design load conditions with the accumulator and charging apparatus interposed in the refrigerant circuit between the evaporator and the compressor and by venting refrigerant fluid from the system until the flow of fluid through the secondary outlet conduit changes from liquid or mixed phase to substantially the vapor phase.

8 Claims, 3 Drawing Figures

REFRIGERANT ACCUMULATOR AND CHARGING APPARATUS AND METHOD FOR VAPOR-COMPRESSION REFRIGERATION SYSTEM

This application is a division of application Ser. No. 421,882, filed 9/23/82, now U.S. Pat. No. 4,474,034.

BACKGROUND OF THE INVENTION

Field of the Invention

This invention pertains to an accumulator and charging unit interposed in the refrigerant conduit between the evaporator and the compressor of a vapor-compression refrigeration system to minimize liquid refrigerant ingestion into the compressor and to provide for rapid, visual and proper charging of the system with refrigerant fluid.

BACKGROUND

A longstanding problem in the art of vapor-compression refrigeration systems pertains to proper charging of the system with the correct amount of refrigerant fluid. If a system is overcharged with fluid there is a tendency to flood the compressor with liquid refrigerant due to incomplete vaporization of the refrigerant fluid as it passes through the evaporator. Moreover, in systems which operate on a repeated on/off cycle it is common for liquid refrigerant to collect in the evaporator and compressor suction conduit, particularly, if the compressor is located at an elevation below the evaporator unit. Accordingly, upon start up of the compressor liquid is ingested into the compression chambers and serious damage to the compressor may be incurred. Therefore, it is desirable to place a pressure vessel in the refrigerant flow circuit between the evaporator and the compressor to provide for minimizing the tendency for liquid to be ingested into the compressor inlet during steady state operating conditions and particularly on start up of the compressor.

A related problem in the installation, servicing and operation of vapor-compression refrigeration systems pertains to the inability to accurately charge the system with the proper amount of refrigerant fluid for design load conditions to prevent refrigerant fluid from failing to evaporate in the evaporator section, which occurs if the system is overcharged, and on the other hand to minimize superheating the refrigerant fluid prior to compression as a result of a system being undercharged. In the former case, inefficient and potentially damaging operation of the system is incurred and, in the latter case, the system operates in an inefficient mode in that a less efficient compression process occurs with superheated refrigerant inlet fluid flowing to the compressor. Although pressure and temperature readings may be taken at various points in a vapor-compression-refrigerant system to ascertain if a proper charge of refrigerant fluid is present, such readings are subject to inaccuracies and in many installations are not conveniently obtainable.

The ideal vapor-compression refrigeration process includes isentropic compression of saturated vapor followed by a constant pressure condensing to saturated liquid, a constant enthalpy expansion and then a constant pressure evaporation process to produce saturated vapor. Although various system inefficiencies prevent the ideal process from occurring in practice an improved apparatus and method in accordance with the present invention provides for visual indication of the condition of the refrigerant fluid flowing through the conduit leading to the compressor inlet and adjustment of the quantity of refrigerant fluid in the system to provide the proper charge of fluid.

SUMMARY OF THE INVENTION

The present invention provides an improved apparatus in the form of a pressure vessel which is adapted to be interposed in the refrigerant flow conduit of a vapor-compression refrigeration system between the evaporator unit and the compressor inlet to minimize the chance of liquid refrigerant ingestion into the compressor and to provide for proper charging of the system with refrigerant fluid. In accordance with one aspect of the present invention the apparatus comprises a pressure vessel forming a chamber including a liquid refrigerant reservoir portion, an inlet conduit portion adapted to be connected to the evaporator discharge conduit, a primary outlet conduit portion in communication with the chamber above the reservoir and adapted to be connected to the compressor suction line and a secondary outlet conduit adapted to be in communication with the reservoir portion of the vessel chamber and with the compressor suction line. The interior chamber of the vessel provides for separation of liquid refrigerant flowing from the evaporator to the compressor and the secondary outlet conduit includes a flow restricting orifice which limits the flow of liquid refrigerant leaving the pressure vessel and flowing to the compressor suction line. The secondary outlet conduit preferably includes a sight class device for observation of the condition of the fluid flowing through the secondary outlet conduit and whereby the amount of liquid refrigerant being discharged from the evaporator may be determined.

In accordance with another aspect of the present invention there is provided an improved apparatus adapted to be interposed in the refrigerant flow circuit of a vapor-compression refrigeration system between the evaporator and the compressor inlet and which is adapted for use in charging the system with the proper amount of refrigerant fluid. The apparatus includes fittings adapted for use of temperature and pressure measuring devices and for introducing liquid refrigerant into the interior chamber of the apparatus when charging the system to contain the proper amount of refrigerant fluid.

In accordance with yet another aspect of the present invention there is provided an improved method for determining the quantity of refrigerant fluid in a vapor-compression refrigeration system wherein an apparatus is provided comprising a closed pressure vessel having an interior chamber including a liquid reservoir portion, an inlet conduit opening into the chamber, a primary outlet conduit in communication with the chamber above the reservoir and a secondary outlet conduit in communication with the reservoir and wherein the secondary outlet conduit includes a visual indicating device to permit observation of the flow of liquid refrigerant, if any, from the apparatus reservoir to the compressor inlet.

The present invention still further provides for an improved method of charging a vapor-compression refrigeration system with the proper amount of refrigerant fluid to prevent flooding the compressor inelt with liquid refrigerant and to prevent substantial superheating of the refrigerant fluid prior to compression.

Those skilled in the art will recognize that the apparatus and method of the present invention is particularly adapted for closed cycle refrigeration systems including expansion devices of the fixed type, such as capillary tubes, although the apparatus and method are by no means limited to use with such systems. Several advantages are realized with the improved apparatus and method of the present invention. Vapor-compression refrigeration systems may be accurately charged by visual inspection of the flow of refrigerant to the compressor inlet. An improved accumulator is provided which provides for continued circulation of oil collected in the liquid refrigerant separating reservoir. Temperatures and pressures at the evaporator outlet may be conveniently and accurately measured. The routing or arrangement of the conduits between the evaporator and the compressor may be selected generally without concern for the problems associated with accumulation of liquid refrigerant in such conduits. The apparatus may be built into or installed in existing systems without substantial modification to the system or flow circuitry therefor. Moreover, the apparatus may be incorporated into a combination accumulator and compressor inlet line filter-dryer.

Those skilled in the art will recognize the advantages and superior features of the system discussed herein as well as other important aspects thereof upon reading the detailed description which follows in conjunction with the drawings.

DESCRIPTION OF THE PREFERRED EMBODIMENTS

Figure 1:
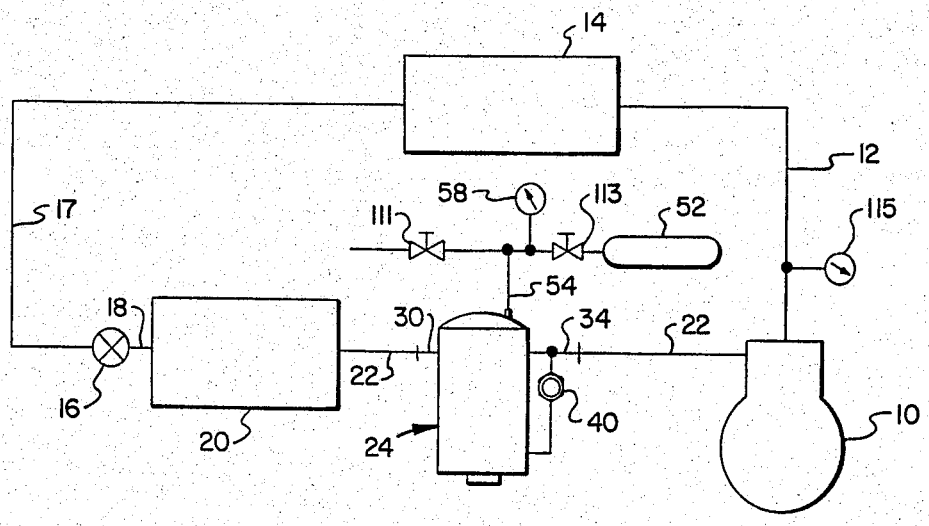
FIG. 1 is a schematic diagram of a vapor-compression refrigeration system including the improved accumulator and refrigerant fluid charging apparatus of the present invention.

In the description which follows like parts are marked throughout the specification and drawings with the same reference numerals, respectively. The drawings are not necessarily to scale and certain features of the apparatus may be exaggerated in scale to better illustrate the invention.

Referring to FIG. 1 there is illustrated a schematic diagram of a typical vapor-compression refrigeration system which has been adapted to include the apparatus of the present invention. The vapor-compression refrigeration system illustrated includes a compressor generally designated by the numeral 10, which is typically of the positive displacement reciprocating or rotary type, although other types of compressors may be used. The compressor 10 includes a refrigerant fluid discharge line 12 which is in communication with a condenser unit 14 for condensing refrigerant vapor discharged from the compressor. The condenser unit 14 is in communication with an expansion device 16 by way of a liquid refrigerant line 17. The expansion device 16 may be one of several types, although the apparatus and method of the present invention operate particularly well with vapor-compression refrigeration systems using a so called fixed expansion device such as a capillary tube or a minimum superheat expansion valve.

Figure 2:
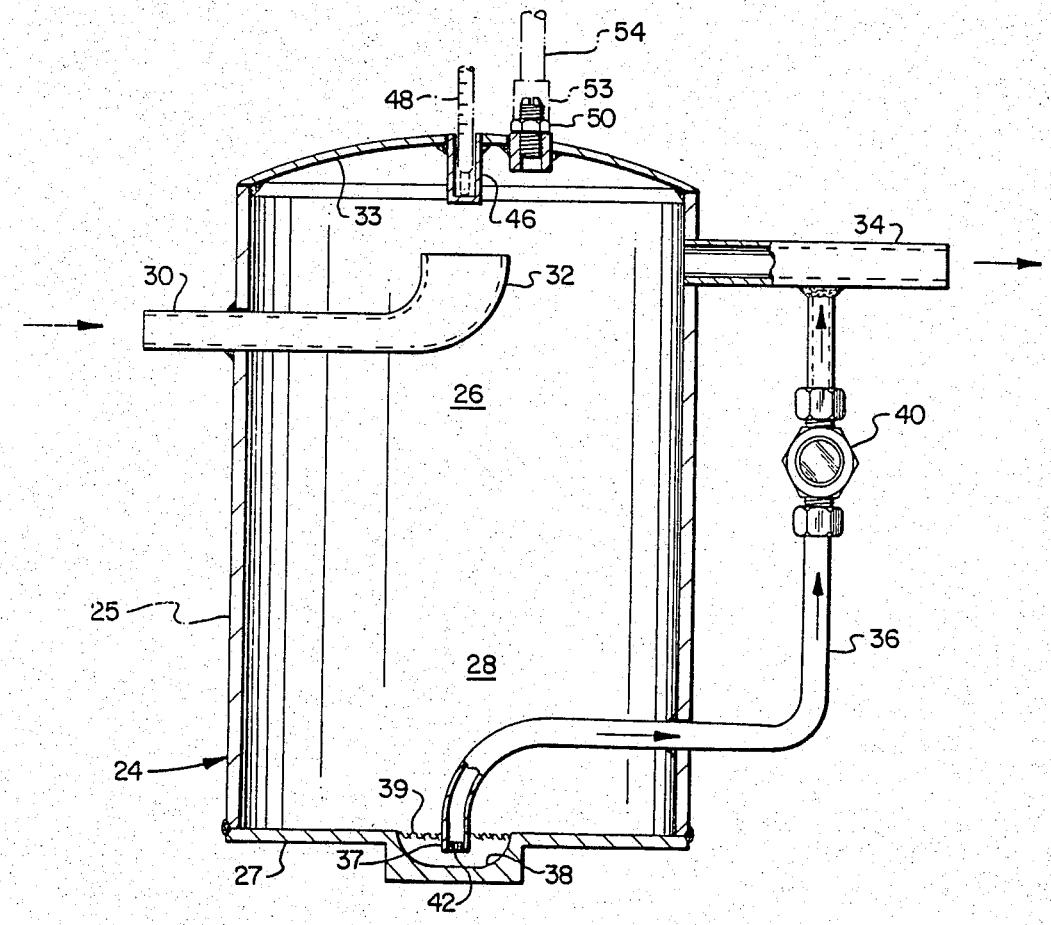
FIG. 2 is an elevation view, in section, of one embodiment of an accumulator and charging apparatus in accordance with the present invention.

The expansion device 16 is connected by way of a conduit portion 18 to an evaporator unit 20. Refrigerant fluid, which is evaporated in the evaporator unit 20 to perform the refrigerating effect, is conducted back to the compressor by way of a conduit 22. In accordance with the present invention there is provided an apparatus which is adapted to be interposed in the conduit 22 between the evaporator and the compressor and which is generally designated by the numeral 24. Referring also to FIG. 2, the apparatus 24 basically comprises a closed pressure vessel which may be constructed in accordance with conventional design practices to, for example, comprise a cylindrical welded steel structure having a cylindrical tubular sidewall 25, a bottom wall 27 and a top wall 33 suitably welded together to operate at the pressures of the particular refrigeration system with which the vessel is used. The pressure vessel 24 includes an interior chamber 26 the lower part of which forms a reservoir portion 28 for receiving refrigerant fluid. The reservoir portion 28 of the pressure vessel 24 may comprise any lower portion of the interior chamber 26 but typically would be considered to be no more than the lower half of the total volume of the interior chamber.

The pressure vessel 24 includes an inlet conduit 30 adapted to be connected to the conduit 22 downstream of the evaporator. The conduit 30 is formed with a flared out right angle elbow portion 32 to direct an incoming flowstream of refrigerant fluid against the inside of the top wall 33 of the pressure vessel generally along the central longitudinal axis thereof. Accordingly, a mixed phase flow of refrigerant fluid entering the chamber 26 through the inlet conduit 30 will impinge against the top wall 33 and any liquid droplets contained in the fluid entering the chamber will be separated by gravitational and inertial forces and fall into the reservoir portion 28.

The pressure vessel 24 also includes a primary refrigerant fluid outlet conduit 34 which is in communication with the interior chamber 26 near the upper end thereof.

The apparatus illustrated in FIG. 2 also includes a secondary outlet conduit 36 which projects through the sidewall of the vessel 24 and is in communication at its inlet end, generally designated by the numeral 37, with a sump 38 formed in the bottom of the reservoir 28. The secondary outlet conduit 36 is also connected to the primary outlet conduit 34, as illustrated, for conducting fluid accumulated in the sump 38 to be entrained with fluid flowing through the outlet conduit refrigerant fluid inlet or suction to the compressor port. The secondary outlet conduit 36 also includes interposed therein means for visually monitoring the fluid flowing through the secondary outlet conduit and comprising a slight glass 40. The sight glass 40 may be any one of several types which are commercially available and which may include indicator means for indicating the presence of water and/or other contaminants in the refrigeration fluid. One source of a suitable sight glass for use with the secondary outlet conduit 36 would be of a type sold under the trademark "SEE ALL" by Sporlan Valve Company, St. Louis, Mo.

The inlet end portion 37 of the secondary outlet conduit is adapted to be provided with flow restricting means comprising an orifice, generally designated by the numeral 42. By arranging the inlet end portion 37 of the secondary outlet conduit in the sump 38 any liquid refrigerant accumulating in the reservoir portion 28 as well as compressor lubricating oil circulating through the refrigerant circuit is induced to flow through the secondary outlet conduit and be conducted to the compressor inlet by way of the primary conduit 34. Flow through the secondary outlet conduit 36 may be induced by proper sizing of the conduit to take advantage of an ejector effect caused by refrigerant vapor flowing through the primary conduit 34 whereby a lower pressure at the juncture of the primary and secondary outlet conduits is sufficient to induce flow from the reservoir sump 38 through the secondary outlet conduit. A filter screen 39 is disposed across the top of the sump 38 to prevent any foreign particles from clogging the orifice 42.

The pressure vessel 24 also includes means for sensing the pressure and temperature conditions of the refrigerant fluid flowing into the chamber 26. As illustrated in FIG. 2, the top wall 33 includes a downwardly projecting tubular portion 46 having a closed lower end and comprising a well for receiving temperature indicating means such as a conventional dry bulb thermometer, generally designated by the numeral 48. The thermometer well 46 is conveniently placed in direct alignment with the discharge flow path of refrigerant fluid exiting from the flared outlet portion 32 of the fluid inlet conduit. Accordingly, the temperature of refrigerant fluid entering the chamber 26 is accurately measured through the use of the thermometer 48 or other temperature sensing device.

The pressure vessel 24 also includes means for access to the chamber 26 for measuring the pressure within the chamber and for introducing refrigerant fluid into the chamber in accordance with a preferred method of using the vessel as will be described further herein. The top wall 33 is adapted to support an access valve 50 for connection of a pressure gauge to measure the pressure of the fluid in the chamber 26 and also to permit introduction of refrigerant fluid from a source such as a pressure vessel 52 shown schematically in FIG. 1. The access valve 50 may be of a type commercially available and commonly used on vapor-compression refrigeration systems and is basically a spring biased check valve which may be opened upon connection of a suitable fitting 53 to the valve to provide for communication with the interior chamber 26 by way of a suitable conduit 54 connected to the source of refrigerant fluid 52 and to a pressure gauge 58 as illustrated schematically in FIG. 1. The access valve 50 may, for example, be of a type commercially available and known in the art as a Schrader valve.

The pressure vessel 24 is preferably physically located in a typical vapor-compression refrigeration system, such as the system illustrated in FIG. 1, in close proximity to the compressor. Moreover, it is important that the vessel 24 be oriented such that the sump 38 is at the lowermost elevation as shown in the drawing figures. By locating the pressure vessel 24 in proximity to the compressor inlet, liquid refrigerant, which may accumulate in the conduit 22 as a result of cyclical on/off operation of the refrigeration system, as a result of a reduced load on the evaporator or overcharging of the system with refrigerant fluid, will flow into the chamber 26 and collect in the reservoir portion 28 and is therefore unlikely to be ingested in any sizable quantity into the compressor through the primary outlet conduit 34. Although some liquid refrigerant may flow through the secondary conduit 36 upon start up of the compressor, the reduced flow rate of liquid, which is restricted by the orifice 42, will not be sufficient to damage the compressor. The physical sizing of the pressure vessel 24 may be on the order of providing a vessel having an interior chamber volume of approximately 157 cubic inches capable of accepting eight lbs. of liquid Refrigerant 22 at 20° F. for vapor-compression refrigeration systems in the range of 3 to 5 tons nominal capacity. The inlet conduit portion 30 is typically a nominal 0.75 inch diameter copper or steel tube, the primary outlet conduit 34 is also a nominal 0.75 to 1.125 inch diameter copper or steel tube and the secondary outlet conduit 36 is typically a nominal 0.25 inch diameter copper or steel tube.

Figure 3:
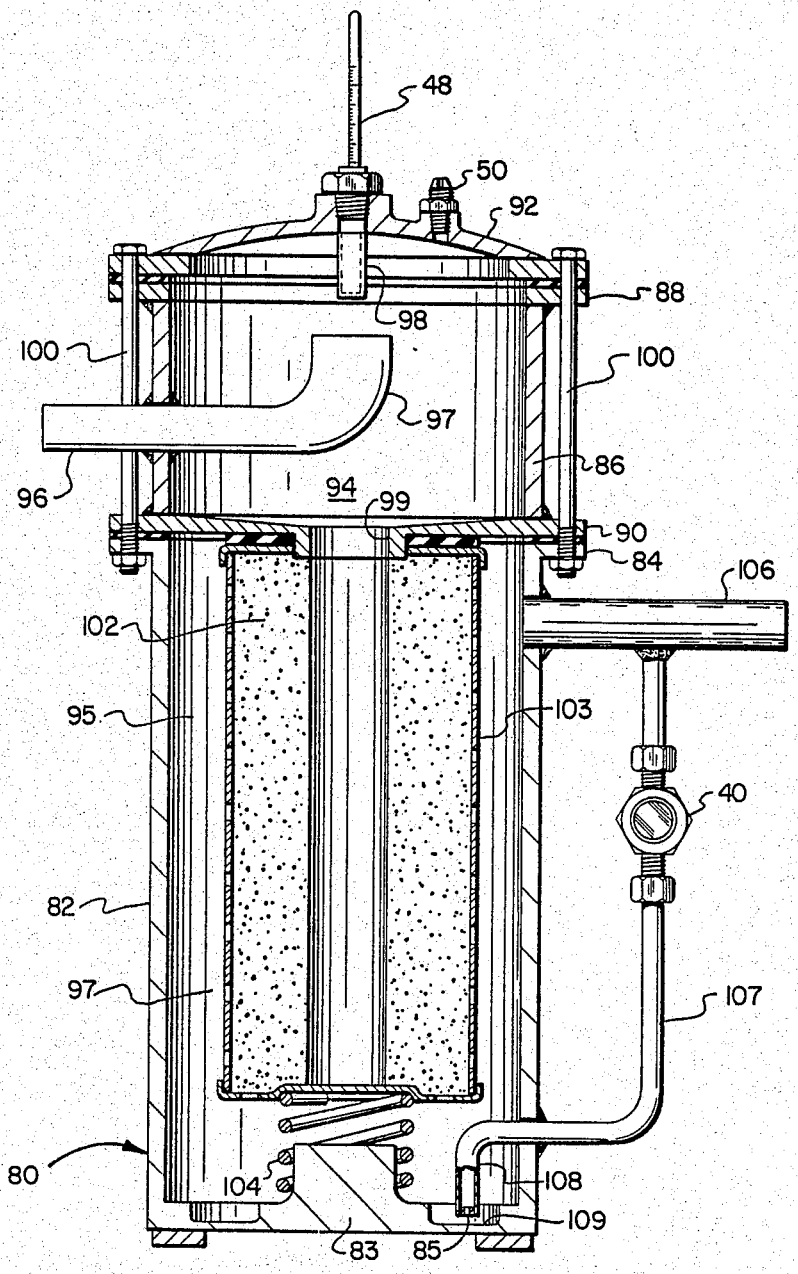
FIG. 3 is an elevation view, in section, of an alternate embodiment of an accumulator and refrigerant charging apparatus in accordance with the present invention.

An alternate embodiment of the accumulator and refrigerant charging apparatus of the present invention is illustrated in FIG. 3. Referring to FIG. 3 there is illustrated a refrigerant accumulator and charging apparatus for a vapor-compression refrigeration system which comprises a closed rpessure vessel, generally designated by the numeral 80. The pressure vessel 80 includes a cylindrical tubular portion 82 having a peripheral flange 84 and a second cylindrical portion 86 provided with opposed flanges 88 and 90. The pressure vessel 80 also includes a removable head portion 92 which comprises a top wall of an interior chamber 94. The pressure vessel 80 further includes an inlet conduit portion 96 having a flared elbow section 97 directed against the head 92 for discharging refrigerant fluid directly toward a thermometer well 98 similar to the thermometer well 46 of the embodiment illustrated in FIG. 2. The head 92 also is adapted to support an access valve 50. The head 92 and the cylinder portion 86 are maintained in assembly with the cylinder portion 82 by a plurality of elongated bolts 100 which are suitably arranged to clamp the head 92 to the flange 84 with the cylinder portion 86 disposed therebetween.

A secondary portion of the chamber 94 is formed by the cylinder portion 82, is generally designated by the numeral 95 and is adapted to receive a porous media element 102. The lower half of the chamber 95 may also be considered a reservoir 97 for collecting liquid refrigerant. The element 102 may comprise a filter for refrigerant fluid and may also include a suitable dessicant for dehydrating refrigerant fluid flowing through the pressure vessel 80. The element 102 is disposed in sealing engagement with the flange 90 by a biasing spring 104 as illustrated. Refrigerant fluid flows into the interior of the element 102 by way of a central opening 99 in the flange 90, through the porous media and through a foraminous container wall 103 into the chamber 95 and out of the pressure vessel 80 by way of a primary outlet conduit 106. The conduit 106 is connected to the chamber 95 at a point generally above the reservoir portion 97 to substantially avoid the induction of liquid refrigerant thereinto.

The pressure vessel 80 also includes a secondary outlet conduit 107 having an inlet end portion 108 disposed in a sump 109 formed in a bottom wall 83 of the cylindrical member 82 and provided with a flow restricting orifice 85 similar to the arrangement of the embodiment illustrated in FIG. 2. The secondary outlet conduit 107 has a sight glass 40 interposed therein in the manner of the arrangement of the embodiment of FIG. 2. Accordingly, the accumulator and charging unit described in conjunction with FIG. 3 incorporates all of the features of the embodiment described in conjunction with FIG. 2 but also includes provision for a filter element which also may include dehydrating media for drying the refrigerant fluid flowing therethrough.

The embodiments of the apparatus described hereinabove in conjunction with FIGS. 2 and 3 are particularly useful for practicing an improved method of determining the presence of an excess or deficient quantity of refrigerant fluid in a vapor-compression refrigeration system and for charging the system to contain the proper amount of fluid. It has been determined in accordance with the present invention that by operating a typical vapor-compression refrigeration system at its design load for both the evaporator and the condenser units that, if an excess quantity of refrigerant is present in the system not all of the refrigerant liquid will be vaporized in the evaporator unit and some will be carried over and accumulate in the reservoir portion of the accumulating and charging apparatus 24 or 80. Accumulation of liquid refrigerant in the reservoir of the apparatus 24 or 80 will be indicated through the sight glass by the pesence of a flow of milky appearing fluid through the secondary outlet conduit portion during steady state operation of the system. Accordingly, with the system operating at desired conditions of load on the evaporator and the condenser, refrigerant fluid may be vented from the vessel interior chamber by way of a valve 111, FIG. 1, while closing a valve 113 leading from the source of refrigerant 52. Of course, refrigerant fluid may be vented from the system at any other convenient point to reduce the quantity of fluid circulating through the system. The quantity of fluid in the system is adjusted until the stream of milky looking fluid flowing through the sight glass disappears and only a trace of oily film is visible on the sight glass indicating the flow of oil with refrigerant vapor through the secondary outlet conduit.

The process of determining the proper charge of refrigerant fluid for a typical vapor-compression refrigeration system utilizing the accumulating and charging apparatus 24 or 80 may also be carried out with a totally discharged unit or a new or reconditioned unit which has been precharged and is ready for connection to the accumulator and charging unit. For example, a typical 3 to 4 ton vapor-compression refrigeration unit utilizing Refrigerant 22 (American Society of Heating, Refrigeration & Air Conditioning Engineers designation) would preferably comprise the following steps. A system into which the accumulator charging unit 24 or 80 is interposed would be evacuated of air or other unwanted gases through a suction conduit, not shown, attached to the access valve 50, for example. Once a predetermined evacuation process was carried out the evacuation line would be closed and liquid refrigerant introduced into the interior chambers of either of the pressure vessels disclosed in FIG. 2 or 3 while observing the accumulation of frost on the exterior of the pressure vessel. Typically, frost should not be allowed to accumulate beyond the vertical midpoint of the vessel 24 or the portion 82 of the pressure vessel 80. Observation of the limit of the frosting will indicate the approximate level of liquid in the interior chambers of the pressure vessels, respectively. Of course, if the system is precharged with refrigerant the actual introduction of an initial charge is normally not required.

After a predetermined time period, or until frost disappears from the exterior of the pressure vessel, the compressor may be placed in operation and the design thermal loads imposed on the condenser and the evaporator units. Typically, for a refrigeration system of from 1 to 4 tons capacity operating with a fixed expansion device such as a capillary tube and utilizing Refrigerant 22, the condenser load may be increased until compressor discharge pressure reaches approximately 280 psig. If compressor discharge pressure cannot be increased to 280 psig it may be necessary at this point to add additional refrigerant to the system. While maintaining a predetermined compressor discharge pressure, including monitoring the pressure at a pressure gauge 115, and maintaining steady state operating conditions, visual observation or monitoring of fluid flow through the sight glass 40 is maintained. If a flow of milky liquid is observed after steady state conditions have been achieved (approximately 15 minutes of operation) the system is indicated to be overcharged. If no milky liquid is present under the above described operating conditions the system may be purposely over charged until milky refrigerant flow does appear through the secondary outlet conduit and continues to appears under steady state operating conditions.

In carrying out the abovedescribed steps the system has been purposely overcharged and without the presence of the pressure vessels 24 or 80 excessive flooding of liquid refrigerant into the compressor inlet would likely be experienced. After shutting off the flow of refrigerant into the system by closing the valve 113 excess refrigerant may be vented through valve 111 until there is no discernible flow of milky liquid through the secondary outlet conduit of the accumulator-charging apparatus. Accordingly, under design operating conditions the compressor is now receiving saturated vapor and an isentropic compression process may be carried out, for example, to yield a more efficient operating cycle than if substantial superheating of the refrigerant fluid flowing through the evaporator were experienced. Moreover, the presence of the accumulator-charging apparatus in the refrigeration system minimizes the chance of ingestion of liquid refrigerant into the compressor inlet in the event of reduced thermal load on the evaporator, particularly for systems operating with fixed expansion devices, or as a result of accumulation of liquid in the evaporator or the refrigerant conduit interconnecting the evaporator with the compressor during shut down of the system.

Thanks to the apparatus and method described above vapor-compression refrigeration systems may be accurately charged with the proper amount of refrigerant fluid without the requirement of monitoring pressures and temperatures throughout the system and without the requirement of measuring the amount of refrigerant fluid charged into the system. Although specific embodiments of the invention have been described herein, those skilled in the art will recognize that various substitutions and modifications may be made to the apparatus and the method of the present invention without departing from the scope and spirit of the invention as recited in the appended claims.

What I claim is:

1. A suction line accumulator for a vapor compression refrigeration system including a compressor, a condenser, a refrigerant expansion device, an evaporator and conduit means interconnecting said compressor and said evaporator, said accumulator being adapted to be inserted in a portion of said conduit means between said expansion device and said compressor to minimize ingestion of liquid refrigerant into said compressor and to provide for charging said system with sufficient refrigerant fluid to minimize superheating said refrigerant fluid prior to entry into said compressor, said accumulator comprising:

a closed pressure vessel defining an interior chamber, said chamber including a portion forming a reservoir for collecting liquid refrigerant being circulated through said system, an inlet conduit in communication with said chamber and adapted to be connected to said conduit means downstream of said evaporator, a primary outlet conduit in communication with said chamber above said reservoir and adapted to be connected to a portion of said conduit means comprising a refrigerant fluid suction line leading to said compressor;

valve means on said vessel including means for connecting said vessel to a source of refrigerant fluid external of said system for charging said system by introducing refrigerant fluid into said chamber and for measuring the fluid pressure in said chamber; and temperature sensing means on said vessel for sensing the temperature of refrigerant fluid entering said chamber from said evaporator during operation of said system whereby the phase condition and amount of superheat of refrigerant fluid entering said chamber from said evaporator may be determined.

2. The accumulator set forth in claim 1 wherein:

said temperature sensing means comprises a thermometer well including a portion projecting into said chamber and positioned to be interposed in the flow path of refrigerant fluid entering said chamber.

3. The accumulator set forth in claim 2 wherein:

said thermometer well is disposed in a top wall of said vessel.

4. The accumulator set forth in claim 1 wherein:

said reservoir includes a sump portion and said accumulator includes a secondary outlet conduit having a fluid inlet end disposed in said sump portion and directly above a bottom wall of said sump portion and a fluid outlet end connected to said primary outlet conduit.

5. The accumulator set forth in claim 1 wherein:

said inlet conduit includes a portion directed against said temperature sensing means and a wall of said chamber for discharging refrigerant fluid toward said temperature sensing means and against said wall to separate liquid refrigerant from refrigerant vapor in said chamber.

6. The accumulator set forth in claim 1 including:

filter means interposed in said chamber for filtering refrigerant fluid flowing through said accumulator.

7. A suction line accumulator for a vapor compression refrigeration system including a compressor, a condenser, a refrigerant expansion device, an evaporator and conduit means interconnecting said compressor and said evaporator, said accumulator being adapted to be inserted in a portion of said conduit means between said expansion device and said compressor to minimize ingestion of liquid refrigerant into said compressor and to provide for charging said system with sufficient refrigerant fluid to minimize superheating said refrigerant fluid prior to entry into said compressor, said accumulator comprising:

a closed pressure vessel defining an interior chamber, said chamber including a portion forming a reservoir for collecting liquid refrigerant being circulated through said system, an inlet conduit in communication with said chamber and adapted to be connected to said conduit means downstream of said evaporator, a primary outlet conduit in communication with said chamber above said reservoir and adapted to be connected to a portion of said conduit means comprising a refrigerant fluid suction line leading to said compressor;

valve means on said vessel including means for connecting said vessel to a source of refrigerant fluid external of said system for charging said system by introducing refrigerant fluid into said chamber and for measuring the fluid pressure in said chamber;

a thermometer well mounted on said vessel and including a portion projecting into said chamber for receiving a thermometer to sense the temperature of refrigerant fluid entering said chamber during operation of said system from said evaporator whereby the phase condition and amount of superheat of refrigerant fluid entering said chamber from said evaporator may be determined; and said inlet conduit includes a portion directed against said thermometer well and a wall of said chamber for discharging refrigerant fluid toward said thermometer well and against said wall.

8. A suction line accumulator for a vapor compression refrigeration system including a compressor, a condenser, a refrigerant expansion device, an evaporator and conduit means interconnecting said compressor and said evaporator, said accumulator being adapted to be inserted in a portion of said conduit means between said expansion device and said compressor to minimize ingestion of liquid refrigerant into said compressor and to provide for charging said system with sufficient refrigerant fluid to minimize superheating said refrigerant fluid prior to entry into said compressor, said accumulator comprising:

a closed pressure vessel including a top wall, sidewall and bottom wall defining an interior chamber, said chamber including a portion forming a reservoir for collecting liquid refrigerant being circulated through said system, an inlet conduit connected to said sidewall and in communication with said chamber and adapted to be connected to said conduit means downstream of said evaporator, a primary outlet conduit connected to said sidewall and in communication with said chamber above said reservoir and adapted to be connected to a portion of said conduit means comprising a refrigerant fluid suction line leading to said compressor;

valve means connected to said top wall of said vessel for connecting said vessel to a source of refrigerant fluid external of said system for charging said system by introducing refrigerant fluid into said chamber and for measuring the fluid pressure in said chamber; and temperature sensing means on said vessel extending through said top wall and interposed directly in the path of refrigerant fluid entering said chamber from said inlet conduit for sensing the temperature of refrigerant fluid entering said chamber from said evaporator whereby the phase condition and amount of superheat of refrigerant fluid entering said accumulator from said evaporator may be determined.

* * * * *

UNITED STATES PATENT AND TRADEMARK OFFICE

CERTIFICATE OF CORRECTION

PATENT NO. : 4,528,826

DATED : July 16, 1985

INVENTOR(S) : Richard J. Avery, Jr.

It is certified that error appears in the above-identified patent and that said Letters Patent is hereby corrected as shown below:

Column 2, line 33, "class" should read --glass--.
Column 6, line 21, "rpessure" should read --pressure--.
Column 8, line 20, "appears" should read --appear--.

Signed and Sealed this

*Twenty-second* Day of *October 1985*

[SEAL]

*Attest:*

DONALD J. QUIGG

*Attesting Officer*

*Commissioner of Patents and Trademarks—Designate*